US011561049B2

(12) United States Patent
Roberts et al.

(10) Patent No.: US 11,561,049 B2
(45) Date of Patent: Jan. 24, 2023

(54) COIL WOUND HEAT EXCHANGER

(71) Applicant: Air Products and Chemicals, Inc., Allentown, PA (US)

(72) Inventors: Mark Julian Roberts, Whitehall, PA (US); Justin David Bukowski, Hamburg, PA (US); Annemarie Ott Weist, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 219 days.

(21) Appl. No.: 16/867,250

(22) Filed: May 5, 2020

(65) Prior Publication Data

US 2021/0348850 A1 Nov. 11, 2021

(51) Int. Cl.

| | |
|---|---|
| ***F28D 7/02*** | (2006.01) |
| ***F28D 7/04*** | (2006.01) |
| ***F28D 7/16*** | (2006.01) |
| ***F28F 9/22*** | (2006.01) |

(52) U.S. Cl.

CPC ..... *F28D 7/04* (2013.01); *F28D 7/024* (2013.01); *F28D 7/1607* (2013.01); *F28F 9/22* (2013.01)

(58) Field of Classification Search

CPC ..... F28D 7/024; F28F 27/02

See application file for complete search history.

(56) References Cited

U.S. PATENT DOCUMENTS

| | | | | |
|---|---|---|---|---|
| 4,313,491 | A * | 2/1982 | Molitor | F28D 7/024 165/83 |
| 6,679,083 | B1 * | 1/2004 | Erickson | F28D 7/024 62/484 |
| 9,562,718 | B2 | 2/2017 | Hodges et al. | |
| 9,982,951 | B2 | 5/2018 | Ho et al. | |
| 2012/0261089 | A1 * | 10/2012 | Steinbauer | F28F 9/0265 165/96 |
| 2013/0068431 | A1 * | 3/2013 | Ho | F28D 7/024 165/163 |

FOREIGN PATENT DOCUMENTS

| | | | | |
|---|---|---|---|---|
| DE | 102007036181 | A1 * | 2/2008 | B01D 5/0006 |
| DE | 102019002704 | A1 * | 10/2020 | F28D 7/022 |
| EP | 942250 | A1 * | 9/1999 | F28D 7/024 |
| JP | 59137797 | A * | 8/1984 | |

* cited by examiner

*Primary Examiner* — Eric S Ruppert

(74) *Attorney, Agent, or Firm* — Amy Carr-Trexler

(57) ABSTRACT

A coil-wound heat exchanger with mixed refrigerant shell side cooling that is adapted to reduce radial temperature maldistribution by providing tube sheets at one end of a warm bundle that are each connected to tube sheets in a single circumferential zone and are in fluid flow communication with a control valve. Tube sheets at the other end of the warm bundle are each connected to tube sheets in a single radial section and in multiple circumferential zones. A temperature sensor is provided in each circumferential zone. When a temperature difference is detected, one or more of the control valves is adjusted to reduce the temperature difference.

11 Claims, 5 Drawing Sheets

COIL WOUND HEAT EXCHANGER

BACKGROUND

Coil-wound heat exchangers ("CWHE") are often a preferred type of heat exchanger used in natural gas liquefaction systems. In a CWHE, the fluid(s) to be cooled are circulated through many layers of tubes that are wrapped around a central mandrel, separated by axial spacers, and contained within a shell space. The assembly of tubes, mandrel and spacers forms a tube bundle, or bundle. Refrigeration is provided by a flow of an expanded refrigerant (often a mixed refrigerant) through the shell space. A common problem with CWHEs is temperature maldistribution of the refrigerant between concentric zones in the shell space, meaning that there is a radial temperature gradient between zones in a particular location between the warm and cold ends of the bundle.

Attempts have been made to correct such radial temperature maldistribution by "zoning" the tube sheets—meaning routing tubes that are connected to each of the cold end and warm end tube sheets through a single zone. This configuration is described in greater detail herein in connection with FIGS. 3 & 3A. Valves are provided upstream of each of the warm end tube sheets to enable flow through each zone to be independently controlled, thereby providing a means for reducing temperature gradients by changing the proportion of tube side flow in each zone to more closely match the proportion of shell side refrigerant in that zone.

Such configurations increase the cost of building the CWHE because the number of tube sheets required at both the cold and warm ends is a function of the number of zones, which often results in a greater number of tube sheets than required to accommodate the number of tubes in the bundle.

Therefore, there is a need for a CWHE configuration that enables flow adjustments to correct radial temperature maldistribution with less of the incremental cost and complexity associated with prior art solutions to radial maldistribution.

SUMMARY

Several specific aspects of the systems and methods of the subject matter disclosed herein are outlined below.

Aspect 1: A coil-wound heat exchanger comprising:

a shell;

a first bundle comprising a first bundle end and a second bundle end located distal to the first bundle end;

a mandrel centrally located within the first bundle, a first bundle shell space extending from the first bundle end to the second bundle end and extending from the first bundle mandrel to the shell;

a plurality of tubes located in the first bundle shell space, each of the plurality of tubes having a first tube end located at the first bundle end and a second tube end located at the second bundle end, the plurality of tubes being wound around the mandrel forming a plurality of wound layers, the plurality of wound layers being divided into a plurality of zones that are concentrically arranged in the first bundle shell space, the plurality of tubes comprising a plurality of tube sets, each of the plurality of tube sets being located in a different one of the plurality of zones;

a first group of tube sheets located at the first bundle end, each of the first group of tube sheets being in fluid flow communication with one of the plurality of tube sets at the first tube end;

a plurality of valves, each of the plurality of valves being in fluid flow communication with each of the first group of tube sheets and located at the first bundle end; and a second group of tube sheets located at the second bundle end, at least one of the second group of tube sheets being in fluid flow communication with more than one of the plurality of tube sets at the second tube end.

Aspect 2: The coil-wound heat exchanger of Aspect 1, wherein the first bundle end is a cold end of the first bundle and the second bundle end is a warm end of the first bundle.

Aspect 3: The coil-wound heat exchanger of any of Aspects 1-2, wherein each of the second group of tube sheets is in fluid flow communication at the second tube end with at least one of the plurality of tubes from each of the plurality of tube sets.

Aspect 4: The coil-wound heat exchanger of any of Aspects 1-3, wherein the second bundle end comprises a plurality of sectors circumferentially arranged around the mandrel, each of the second group of tube sheets being in fluid flow communication with second tube ends originating from a single one of the plurality of sectors.

Aspect 5: The coil-wound heat exchanger of any of Aspects 1-4, further comprising a temperature sensor located in each of the plurality of zones.

Aspect 6: The coil-wound heat exchanger of Aspect 5, wherein the warm bundle has a bundle height extending from the cold bundle end to the warm bundle end and each of the temperature sensors is located within a middle 50% of the bundle height.

Aspect 7: The coil-wound heat exchanger of Aspect 5, wherein the warm bundle has a bundle height extending from the cold bundle end to the warm bundle end and each of the temperature sensors is located within a middle 20% of the bundle height.

Aspect 8: The coil-wound heat exchanger of any of Aspects 1-7, further comprising a first inlet conduit in fluid flow communication with the first group of tube sheets and the second group of tube sheets and a second inlet conduit in fluid flow communication with a third group of tube sheets and a fourth group of tube sheets.

Aspect 9: The coil-wound heat exchanger of Aspect 8, wherein the third group of tube sheets is located at the first bundle end, each of the third group of tube sheets being in fluid flow communication with more than one of the plurality of tube sets at the first tube end and the second group of tube sheets is located at the second bundle end, each of the second group of tube sheets being in fluid flow communication with more than one of the plurality of tube sets at the second tube end.

Aspect 10: The coil-wound heat exchanger of any of Aspects 1-9, wherein the plurality of zones comprise an innermost zone and an outermost zone, wherein at least one of the innermost zone and the outermost zone each contains between 10 and 20 percent of the plurality of tubes.

Aspect 11: The coil-wound heat exchanger of any of Aspects 1-10, wherein the plurality of zones comprise an innermost zone and an outermost zone, wherein at least one of the innermost zone and the outermost zone each contains less than 10 percent of the plurality of tubes.

Aspect 12: A method of making a coil-wound heat exchanger, the method comprising:

(a) forming a warm bundle having a warm end and a cold end by winding a plurality of tubes around a mandrel to form a plurality of tube layers, the plurality of tube layers being divided among a plurality of zones, the plurality of zones being concentrically arranged throughout the warm bundle;

(b) providing a shell that defines a shell space between the shell and the mandrel;

(c) connecting each of a first group of tube sheets to a first subset of the plurality of tubes, each first subset comprising tubes located in a plurality of zones, the first group of tube sheets located at one selected from the group of the warm end and the cold end of the warm bundle;

(d) connecting each of a second group of tube sheets to a second subset of the plurality of tubes, each of the second subset comprising tubes located in one zone of the plurality of zones, the second group of tube sheets located at a different one selected from the group of the warm end and the cold end of the warm bundle than the first group of tube sheets; and (e) providing a valve in downstream fluid flow communication with each of the second group of tube sheets.

Aspect 13: The method of Aspect 12, further comprising:

(f) forming a cold bundle within the shell space, the cold bundle being in fluid flow communication with at least some of the plurality of tubes.

Aspect 14: The method of any of Aspects 12-13, further comprising:

(g) placing a temperature sensor in each of the plurality of zones.

Aspect 15: The method of any of Aspects 12-14, further comprising:

(h) placing a temperature sensor in each of the plurality of zones within a middle 50% of a warm bundle height, the warm bundle height extending from the warm and of the warm bundle to the cold end of the warm bundle.

Aspect 16: The method of any of Aspects 12-15, further comprising:

placing a temperature sensor in each of the plurality of zones within a middle 20% of a warm bundle height, the warm bundle height extending from the cold end to the warm end.

Aspect 17: A system for liquefying a feed gas, the system comprising:

a coil-wound heat exchanger comprising a warm bundle, a shell, and a shell space contained within the shell, the warm bundle comprising:

a warm end and a cold end;

a mandrel centrally located within the warm bundle, a warm bundle shell space extending from the warm end to the cold end and extending from the mandrel to the shell;

a plurality of tubes located in the first bundle shell space, each of the plurality of tubes having a first tube end located at the warm end of the warm bundle and a second tube end located at the cold end of the warm bundle, the plurality of tubes being wound around the mandrel forming a plurality of wound layers, the plurality of wound layers being divided into a plurality of zones that are concentrically arranged in the first bundle shell space, the plurality of tubes comprising a plurality of tube sets, each of the plurality of tube sets being located in a different one of the plurality of zones;

a feed circuit having a feed stream conduit, a plurality of warm end tube sheets located at the warm end, a plurality of cold end feed tube sheets located at the cold end, and a product conduit, the plurality of warm end feed tube sheets and the plurality of cold end feed tube sheets being in fluid flow communication with a first group of the plurality of tubes, the feed stream conduit, the plurality of warm end feed tube sheets, the plurality of cold end feed tube sheets, and the product conduit all being in fluid flow communication;

a refrigerant circuit comprising a closed loop, the at least one refrigerant circuit comprising:

a compression circuit comprising at least one compression stage and at least one selected from the group of an intercooler and an aftercooler;

a refrigerant stream conduit;

a plurality of warm end refrigerant tube sheets in downstream fluid flow communication with the refrigerant stream conduit;

a plurality of cold end refrigerant tube sheets located at the cold end in downstream fluid flow communication with the plurality of warm end refrigerant tube sheets; and a cooled refrigerant conduit in downstream fluid flow communication with the plurality of cold end refrigerant tube sheets;

an expansion valve in downstream fluid flow communication with the cooled refrigerant conduit;

an expanded refrigerant conduit in downstream fluid flow communication with the expansion valve and in upstream fluid flow communication with the shell space at the cold end; and a vaporized refrigerant conduit in located at the warm end, the vaporized refrigerant conduit being in downstream fluid flow communication with the shell space and in upstream fluid flow communication with the compression circuit;

wherein the plurality of warm end refrigerant tube sheets and the plurality of cold end refrigerant tube sheets are in fluid flow communication with a second group of the plurality of tubes;

wherein the refrigerant stream conduit, the plurality of warm end refrigerant tube sheets, the plurality of cold end refrigerant tube sheets, and the cooled refrigerant conduit are all in fluid flow communication;

wherein each tube sheet of a first selected from the group of the warm end feed tube sheets and cold end feed tube sheets is in fluid flow communication with only one of the plurality of tube sets and each tube sheet of a second selected from the group of the warm end feed tube sheets and cold end feed tube sheets is in fluid flow communication with more than one of the plurality of tube sets.

Aspect 18: The coil-wound heat exchanger of Aspect 17, further comprising a temperature sensor located in each of the plurality of zones.

Aspect 19: The coil-wound heat exchanger of Aspect 18, wherein the warm bundle has a bundle height extending from the cold bundle end to the warm bundle end and each of the temperature sensors is located within a middle 50% of the bundle height.

Aspect 20: The coil-wound heat exchanger of Aspect 18, wherein the warm bundle has a bundle height extending from the cold bundle end to the warm bundle end and each of the temperature sensors is located within a middle 20% of the bundle height.

Aspect 21: A method of operating the coil-wound heat exchanger of any of Aspects 1-20, the method comprising:

(a) measuring a zone temperature in each of the plurality of zones; and (b) reducing a difference between the zone temperatures of two zones of the plurality of zones by adjusting a position of at least one of the plurality of valves.

BRIEF DESCRIPTION OF THE DRAWING(S)

Figure 4A:
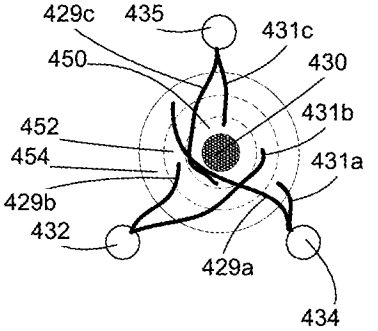
Figure 4B:
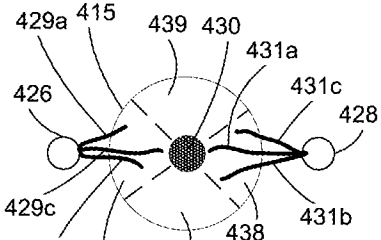
Figure 4:
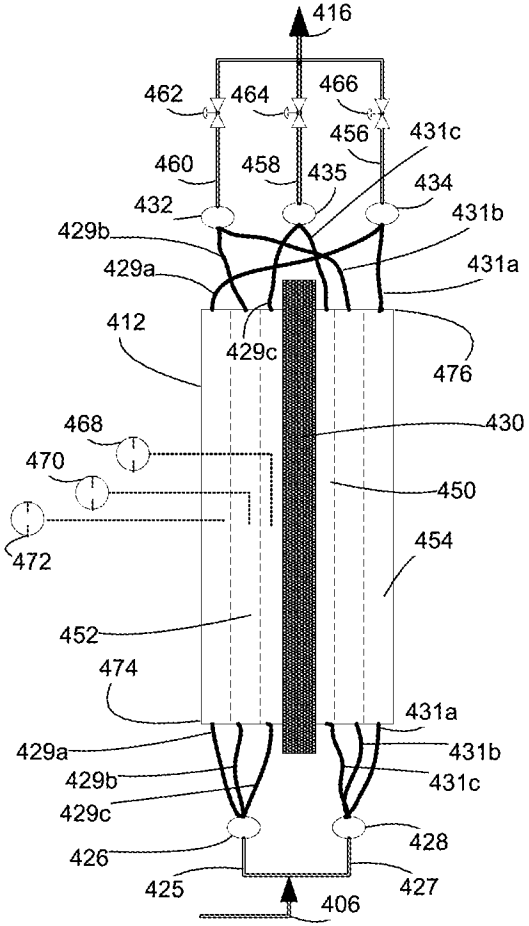
Figures 5, 5A, 5B:
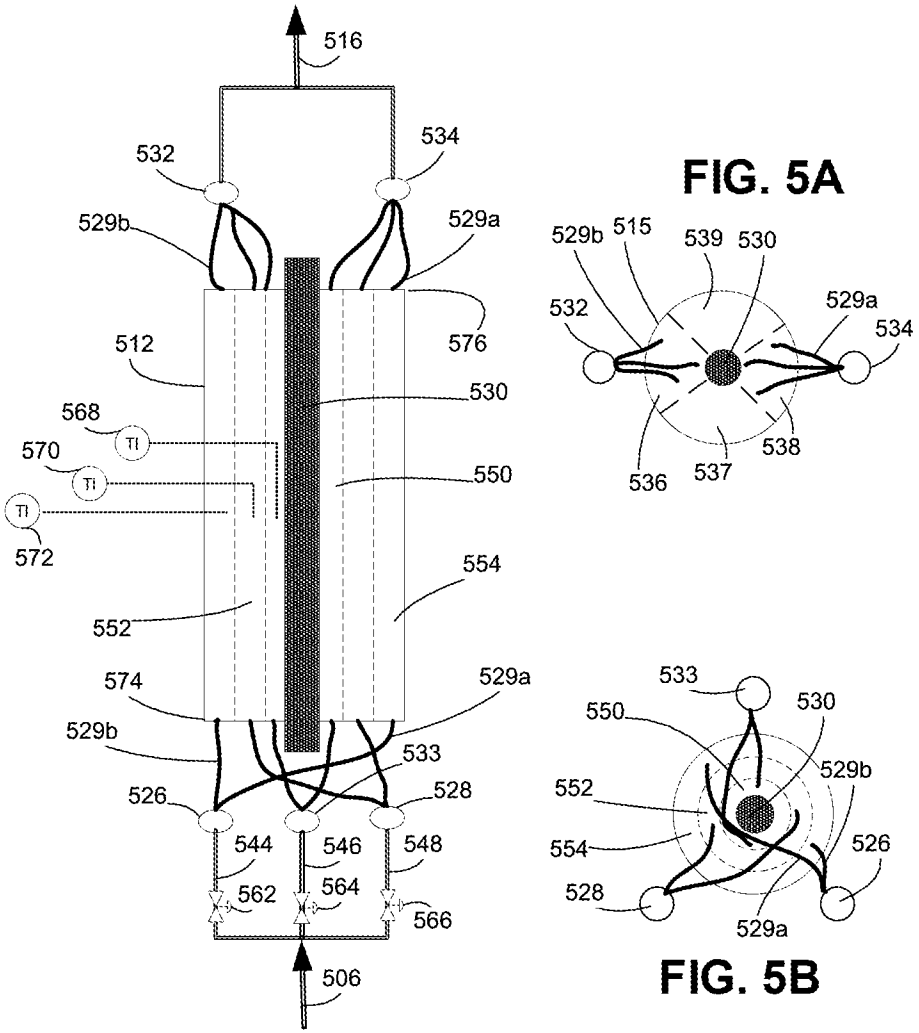

FIGS. 4, 4A and 4B are schematic elevation, top and bottom views, respectively, of a first exemplary embodiment of a coil-wound heat exchanger implementing inventive concepts of the present invention; and FIGS. 5, 5A and 5B are schematic elevation, top and bottom views, respectively, of a second exemplary embodiment of a coil-wound heat exchanger implementing inventive concepts of the present invention.

DETAILED DESCRIPTION OF THE PREFERRED EMBODIMENT(S)

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention.

In order to aid in describing the invention, directional terms may be used in the specification and claims to describe portions of the present invention (e.g., upper, lower, left, right, etc.). These directional terms are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the present invention (e.g., upper, lower, left, right, etc.). These directional terms are merely intended to assist in describing exemplary embodiments and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "circuit", as used in the specification and claims, is intended to refer to a group of conduits and other equipment through which a particular fluid flows. In an open circuit, all of the fluid that enters the circuit at an upstream end will also exit the circuit at a downstream end, allowing for losses due to leakage. In closed circuit, all of the fluid in the circuit (again allowing for losses due to leakage) circulates a closed loop, through a group of conduits and other equipment.

Figure 1:
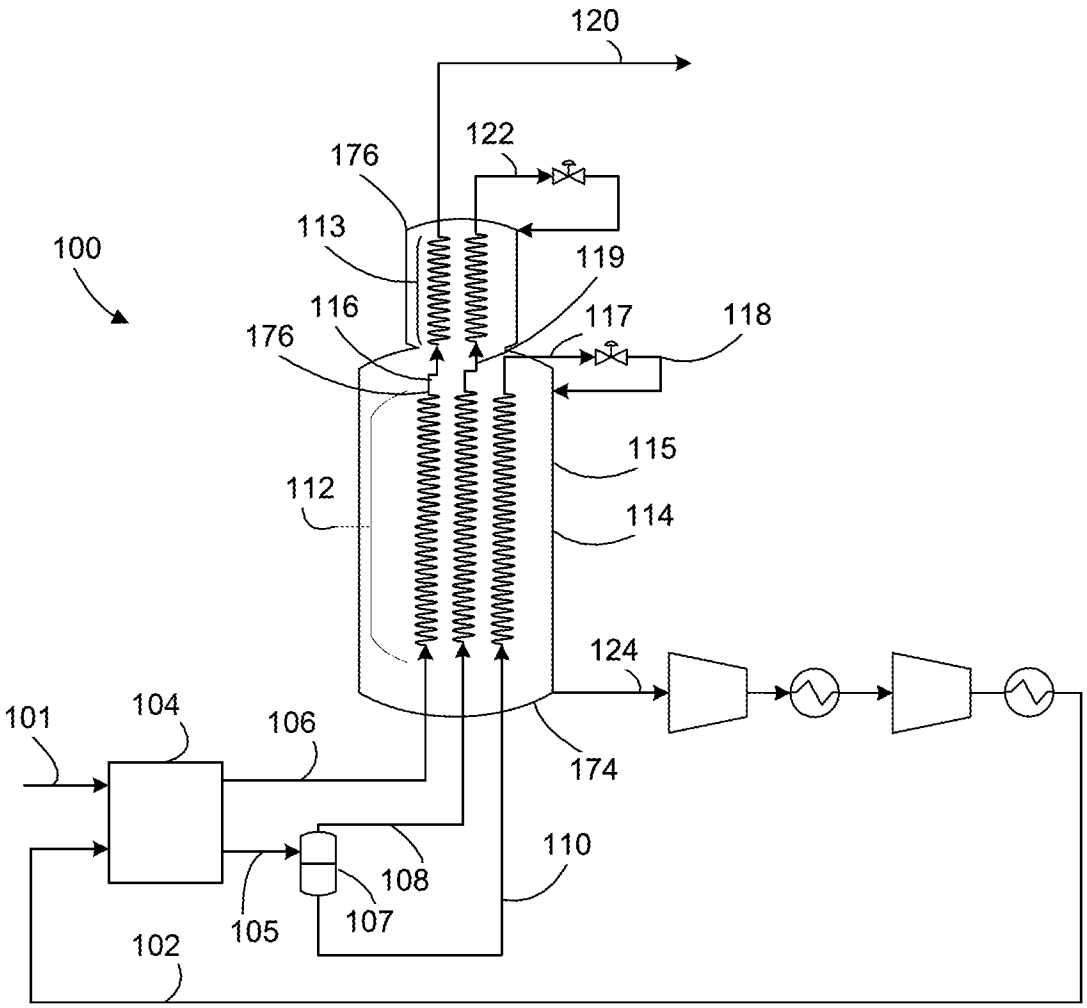
FIG. 1 (Prior Art)
FIG. 1 is a schematic view of an exemplary embodiment of a natural gas liquefaction system.

FIG. 1 shows an exemplary natural gas liquefaction system 100 using a coil-wound heat exchanger ("CWHE") 114 having a warm bundle 112, a cold bundle 113, and a shell 115. A feed stream 101, comprising natural gas, and a mixed refrigerant stream 102 are pre-cooled in a precooling system 104 to form a pre-cooled feed stream 106 and a pre-cooled mixed refrigerant stream 105. The pre-cooled mixed refrigerant stream 105 is then separated into a vapor ("MRV") stream 108 and a liquid ("MRL") stream 110 using a phase separator 107. The pre-cooled feed stream 106 and the MRV stream 108 each enter the warm bundle 112 at a warm end 174 and exit at a cold end 176, where each is cooled to about −110 degrees C. and condensed by refrigeration provided to the shell side of the CWHE 114 from vaporization of an expanded MRL stream 118 to form a cooled feed stream 116 and a cooled MRV stream 119. The MRL stream 110 also enters the warm bundle 112 at the warm end 174 and exits at the cold end 176, where it is cooled to about −110 degrees C. to form a subcooled MRL stream 117.

The subcooled MRL stream 117 is reduced in pressure to form the expanded MRL stream 118, while the cooled feed stream 116 and cooled MRV stream 119 are further cooled to around −150° C. in the cold bundle 113 of the CWHE 114 to form a product stream 120, comprising liquid natural gas ("LNG"), and a subcooled liquid MRV stream 122 which is reduced in pressure and sent to the shell side of the cold bundle 113 where it is vaporized to provide refrigeration.

A vaporized mixed refrigerant stream 124 exits the shell side of the CWHE 114 at the warm end 174, is compressed to 40-70 bar, then cooled to form the mixed refrigerant stream 102, thereby completing the refrigeration loop.

It should be understood that the natural gas liquefaction system 100 shown in FIG. 1 is intended to be exemplary and provide context for the invention. The inventive concepts described herein could be implemented on applications in which a coil wound heat exchanger is used.

In each of the subsequent embodiments disclosed herein, elements shared with the first embodiment (system 100) are represented by reference numerals increased by factors of 100. For example, the warm bundle 112 shown in FIG. 1 corresponds to the warm bundle 212 of FIG. 2 and the warm bundle 312 of FIG. 3. In the interest of balancing clarity and brevity, some features of subsequent embodiments that are shared with the first embodiment are numbered in the figures but are not separately called out in the specification.

Figure 2A:
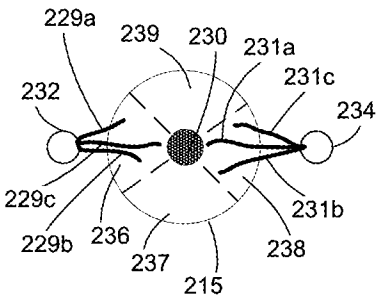
FIG. 2A (Prior Art)
FIGS. 2, 2A and 2B are schematic elevation, top and bottom views, respectively, of a first exemplary prior art coil-wound heat exchanger.
Figure 2B:
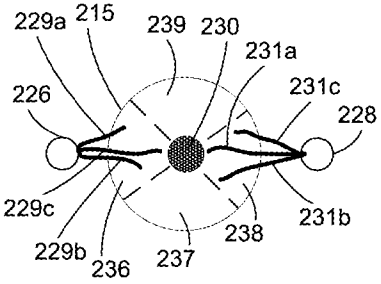
FIG. 2B (Prior Art)
Figure 2:
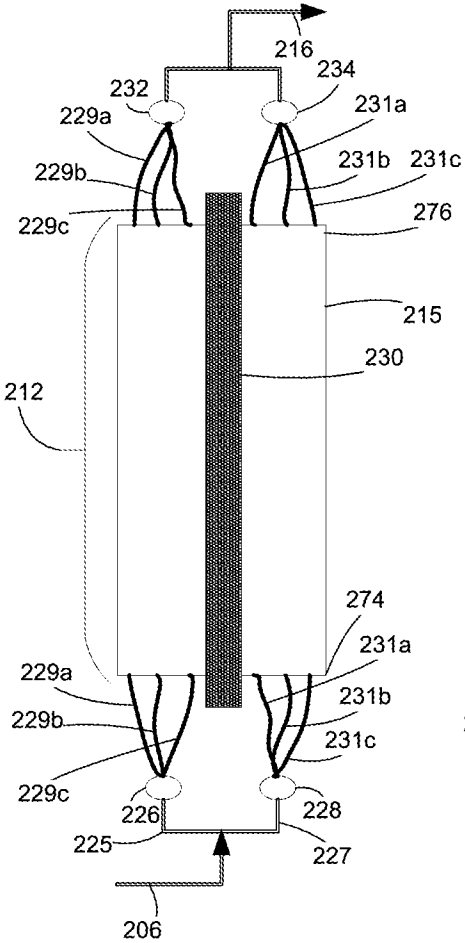
FIG. 2 (Prior Art)

FIG. 2 shows an example of a conventional arrangement of a circuit within a CWHE bundle. In this example, the feed circuit is shown. The pre-cooled feed stream 206 is cooled and exits the warm bundle 212 as the cooled feed stream 216 (corresponding to warm bundle 112 and cooled feed stream 116, respectively, in FIG. 1).

At the warm end 274 of the warm bundle 212, the pre-cooled feed stream 206 is split into multiple sub streams 225, 227, which feed warm end tube sheets 226, 228 respectively. The tube sheets 226, 228 each feed multiple process tubes 229*a-c*, 231*a-c*, respectively. Tube sheets are, in essence, manifolds that distribute fluid flow from a sub-stream 225, 227 into the process tubes 229*a-c*, 231*a-c*, which are wound around the mandrel 230 to form the warm bundle 212.

Although two tube sheets 226, 228 are shown in this example, any number of tube sheets could be used, depending on the number of process tubes in the circuit. Similarly, in the interest of simplifying the drawings, only three exemplary process tubes 229*a-c*, 231*a-c* are shown as being in fluid flow communication with each of the tube sheets 226, 228. For a typical LNG application, a tube bundle (meaning all of the process tubes in a section of a coil-wound heat exchanger) typically has thousands of tubes wound in 50-120 concentric tube layers wound around the mandrel 230, with layers being separated by axial spacers (not shown). A typical tube bundle has a diameter from 2-5 m and a length of 5-20 m.

At the cold end of the warm bundle 212, the process tubes 229*a-c*, 231*a-c* are consolidated into cold end tube sheets 232 and 234 with the cooled fluid being combined into the cooled feed stream 216. In order to show where each exemplary process tube 229*a-c*, 231*a-c* enters and exits the warm bundle 212, each is labeled at the warm end 274 and the cold end 276 of the warm bundle 212.

FIGS. 2A and 2B are diagrams that schematically represent the arrangement of process tubes at the cold end 276 and warm end 274 of the warm bundle 212, respectively. The warm bundle 212 is divided into a plurality of pie-shaped sectors 236-239, which are circumferentially arranged about the mandrel 230 and each of which extend from the mandrel 230 to the shell 215. At the warm end 274, the process tubes 229*a-c*, 231*a-c* from each tube sheet 226 and 228 enter the warm bundle 212 in one of the pie shaped sectors 236 and 238, respectively. This results in each tube sheet 226, 228 having process tubes that are routed through multiple layers of the warm bundle 212. Similarly, at the cold end 276, the process tubes 229*a-c*, 231*a-c* which exit the warm bundle 212 and are joined at tube sheets 232 and 234, respectively, exit the bundle in the pie shaped sectors 236, 238, respectively.

Having all of the process tubes for each tube sheet enter and exit each bundle in a single pie-shaped sector that is adjacent to the tube sheets enables the portions of the process tubes that connect the bundle to the tube sheet to be relatively short and enables the avoidance of process tubes crossing over one another. Accordingly, this configuration is preferred in many conventional implementations because it simplifies manufacture of the CWHE.

Portions of the warm bundle 212 not occupied by process tubes through which the pre-cooled feed stream 206 flows are occupied by tubes through which the MRV stream (not shown) or the MRL stream (not shown) flow. Such tubes typically have their own tube sheets. In the interest of simplifying the drawings, tubes and tube sheets for the MRV stream or the MRL stream are omitted.

Figure 3A:
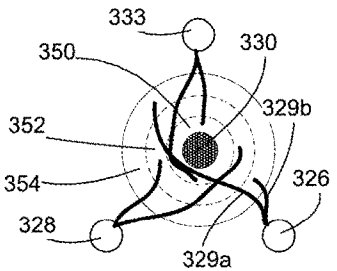
FIG. 3A (Prior Art)
FIGS. 3 and 3A are schematic elevation and bottom views, respectively, of a second exemplary prior art coil-wound heat exchanger.
Figure 3:
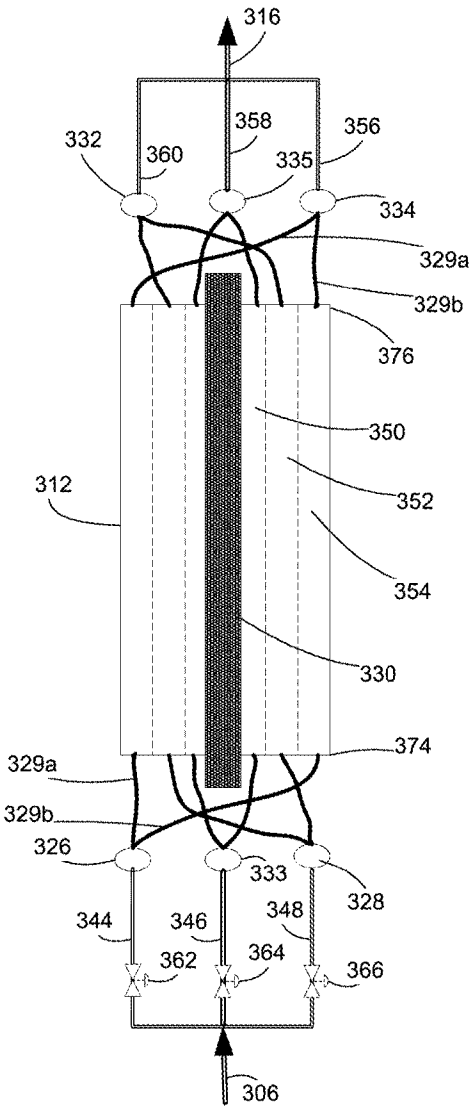
FIG. 3 (Prior Art)

FIG. 3 depicts a prior art configuration described in U.S. Pat. Nos. 9,562,718 and 9,982,951. In these references, the pre-cooled feed stream 306 is divided into three sub-streams 346, 348 and 344, each of which feeds a warm end tube sheet 333, 328, 326, respectively. The warm bundle 312 is divided into concentric heat exchange zones—an inner zone 350, a middle zone 352, and an outer zone 354. All of the process tubes associated with each one of the warm tube sheets 326, 328, 333 are located in a single zone. For example, all of the process tubes 329*a-b* of warm end tube sheet 326 are both directed to the outer zone 354. All of the process tubes associated with each one of the cold end tube sheets 332, 334, 335 are also directed to a single zone. For example, all of the process tubes 329*a-b* which terminate in the cold end tube sheet 334 are withdrawn from the outer zone 354. In order to simplify the figures, only the process tubes 329*a-b* associated with the warm end tube sheet 326 and the cold end tube sheet 334 are labeled with reference numbers in FIGS. 3 & 3A.

This configuration results in fluid remaining separate throughout the process. For example, all of the fluid entering the warm bundle 312 through sub stream 344 exits the warm bundle through sub stream 356. In other words, each of the warm end tube sheets 326, 328, 333 is in fluid flow communication with only one of the cold end tube sheets 334, 332, 335.

The configuration of FIGS. 3 & 3A is intended to reduce "radial maldistribution"-meaning the uneven cooling of fluids in the warm bundle in different zones. To that end, the CWHE includes valves 362, 366, 364 upstream from each of the warm end tube sheets 326, 328, 333, respectively, to equalize the temperature of sub streams 356, 360 and 358 exiting the cold end tube sheets 334, 332, 335.

This solution to the radial maldistribution problem has several drawbacks. Firstly, more tube sheets may be required to provide a tube sheet for each zone than would be required based purely on the number of tubes in the bundle. In addition, this solution requires additional valves to be positioned at the warm end of the warm bundle.

FIGS. 4, 4A, and 4B show an exemplary inventive embodiment. In this embodiment, the feed stream 406 is fed to the warm end 474 of the warm bundle 412 using the optimal number of tube sheets 426,428 (in this case, two) for this warm bundle 412. As shown FIG. 4B, the process tubes 429*a-c*,431*a-c* from each tube sheet 426,428 are each routed to one pie-shaped sector 436, 438, respectively. For example, the process tubes 429*a-c* of tube sheet 426 all enter the bundle in sector 436.

At the cold end 476, the process tubes 429*a-c*,431*a-c* are routed from the warm bundle 412 to the cold end tube sheets 432,434,435 so that each of the cold end tube sheets 432, 434,435 is in fluid flow communication process tubes from a single zone. For example, each of the process tubes 429*a*,431*a* from the outer zone 454 terminate at cold end tube sheet 434. A control valve 462, 464 and 466 is located on each of the sub streams 460, 458, 456 at the cold end 476 of the warm bundle 412.

A temperature sensor 468, 470, 472 is provided in each of the zones 450, 452, 454 in the shell space of the warm bundle 412. The temperature sensors 468, 470, 472 are preferably located within the warm bundle 412 at an intermediate location, preferably within the middle 50% (more preferably within the middle 20%) of the height of the warm bundle 412. Alternatively, the temperature sensors 468, 470, 472 could be located at the cold end 476. An intermediate location is preferred because cold end temperatures may not always reflect radial maldistribution.

In the event that a temperature difference is detected between the temperature sensors 468, 470, 472, flow to the appropriate zone 450, 452, 454 can be adjusted using the control valve 462, 464 and 466 in a manner designed to reduce the temperature differential. For example, if the temperature sensor 472 reads significantly lower than temperature sensor 470, the temperature differential can be reduced by either incrementally opening control valve 466 or incrementally closing control valves 462, 464. Monitoring of the temperature sensors 468, 470, 472, and operation of the control valves 462, 464 and 466 can either be executed manually or with a controller (not shown). It is desirable that the control valves 462, 464 and 466 all be as open as possible, in order to maximize flow capacity of the system. Accordingly, if no radial maldistribution is detected, all of the control valves 462, 464 and 466 will normally be fully open. When radial maldistribution is detected, at least one of the control valves 462, 464 and 466 will normally be fully open.

While temperature measurements of the outlet sub streams 456, 458 and 460 could be used to guide the manipulation of the valves as in the prior art, using internal bundle temperatures (i.e., in the shell space) is preferable. Depending on the current operation, temperatures of the sub streams at the cold end may be very similar despite significant radial temperature gradients in the shell space at an intermediate location along the height of the warm bundle. For example, if the CWHE is operated with a high shell side refrigerant flow rate relative to the tube side flow rates, the exchanger may be "pinched" at the cold end, meaning the temperature difference between the shell side fluid and the tube side fluids are very small and the temperature difference between outlet sub streams also very small.

The configuration of FIG. 4 enables simplified manufacturing of the CWHE as compared to the embodiment of FIG. 3. The number of tube sheets at the warm end 474 is reduced to the minimum required based on the number of process tubes and enables a simplified arrangement of process tubes at one end of the warm bundle 412, while maintaining the ability to reduce radial maldistribution through zoned flow control. Another advantage of the exemplary embodiment of FIG. 4 is that the control valves 462, 464 and 466 are located at the cold end 476 of the warm bundle, where the feed stream and MRV streams are at least partially liquefied. This greatly reduces the size of the valves required compared to locating the valves at the warm end 474, where these streams are gas phase.

The exemplary embodiment shown in FIG. 5, the configuration of the tube sheets and control valves is reversed, with zone-specific tube sheets 526, 533, 528 and control valves 562, 564, 566 being located at the warm end 574 and the sector-specific tube sheets 532, 534 being located at the cold end 576. This configuration provides many of the advantages of the embodiment of FIG. 4 but, as noted above, requires larger control valves 562, 564, 566.

It should be noted that the number of zones and relative size of each zone shown in FIGS. 3 through 5 is merely exemplary. Depending upon the application, it may be desirable to define a greater or lesser number of zones. In addition, it may be desirable to define zones that are not equal in radial width. For example, the outer zone 554 may be thinner (i.e., include a smaller number of tube layers) than the inner zone 550. The preferred number and radial width of each zone in a particular application is, in part, a function of the expected radial maldistribution. For example, the zones may be defined to include substantially the same number of tubes in each zone. In an alternative embodiment, the innermost zone and/or the outermost zone would each be defined to include between 10% and 20% of the total number of tubes of the circuit. In yet another alternative embodiment, the innermost and/or the outermost would each be defined to include less than 10% of the total number of tubes in the circuit.

The preferred number of zones may also depend on the number of tubes in the circuit that is being divided. The number of tubes may dictate the minimum number of tube sheets, for example if three tube sheets are required it may be convenient to divide the exchanger into three zones, even if only two are needed to mitigate the expected maldistribution.

It should also be noted FIGS. 4-5B all show the portions of the warm bundle 412, 512 associated with the feed gas circuit. In each embodiment and as described in connection with FIG. 1, at least one mixed refrigerant circuit would also be provided. In many embodiments, a vapor mixed refrigerant circuit and a liquid mixed refrigerant circuit would be provided.

Radial temperature gradients may indicate that there is a mismatch between the radial distribution of shell side refrigerant and radial distribution of tube side heat load. The invention allows the radial distribution of tubeside flow and therefore heat load to be adjusted to better match the radial distribution of shellside refrigerant, resulting in reduction of the radial temperature gradient.

It is preferable that at least one of the circuits have the cold and warm end tube sheet configuration of one of the embodiments of FIGS. 4-4B and FIGS. 5-5B. In some applications, the radial distribution of only the one circuit may need to be adjusted to provide sufficient redistribution of the tube side heat load to reduce the radial temperature gradient. For example, in such embodiments, the feed circuit could have the tube sheet configuration of one of the embodiments of FIGS. 4-4B and FIGS. 5-5B and each of the refrigerant circuits could have the tube sheet configuration of FIGS. 2-2B. In other applications, the radial distribution of two circuits may need to be adjusted to provide sufficient redistribution of the tubeside heat load to reduce the radial temperature gradient. For example, in one such embodiment, the feed circuit and the MRV circuit could each have the tube sheet configuration of one of the embodiments of FIGS. 4-4B and FIGS. 5-5B and the MRL circuit could have the tube sheet configuration of FIGS. 2-2B.

As such, an invention has been disclosed in terms of preferred embodiments and alternate embodiments thereof. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A coil-wound heat exchanger comprising:

a shell;

a first bundle comprising a first bundle end and a second bundle end located distal to the first bundle end;

a mandrel centrally located within the first bundle, a first bundle shell space extending from the first bundle end to the second bundle end and extending from the first bundle mandrel to the shell;

a plurality of tubes located in the first bundle shell space, each of the plurality of tubes having a first tube end located at the first bundle end and a second tube end located at the second bundle end, the plurality of tubes being wound around the mandrel forming a plurality of wound layers, the plurality of wound layers being divided into a plurality of zones that are concentrically arranged in the first bundle shell space, the plurality of tubes comprising a plurality of tube sets, each of the plurality of tube sets being located in a different one of the plurality of zones;

a first group of tube sheets located at the first bundle end, each of the first group of tube sheets being in fluid flow communication with one of the plurality of tube sets at the first tube end;

a plurality of valves, each of the plurality of valves being in fluid flow communication with each of the first group of tube sheets and located at the first bundle end; and a second group of tube sheets located at the second bundle end, at least one of the second group of tube sheets being in fluid flow communication with more than one of the plurality of tube sets at the second tube end.

2. The coil-wound heat exchanger of claim 1, wherein the first bundle end is a cold end of the first bundle and the second bundle end is a warm end of the first bundle.

3. The coil-wound heat exchanger of claim 1, wherein each of the second group of tube sheets is in fluid flow communication at the second tube end with at least one of the plurality of tubes from each of the plurality of tube sets.

4. The coil-wound heat exchanger of claim 1, wherein the second bundle end comprises a plurality of sectors circumferentially arranged around the mandrel, each of the second group of tube sheets being in fluid flow communication with second tube ends originating from a single one of the plurality of sectors.

5. The coil-wound heat exchanger of claim 1, further comprising a temperature sensor located in each of the plurality of zones.

6. The coil-wound heat exchanger of claim 5, wherein the warm bundle has a bundle height extending from the cold bundle end to the warm bundle end and each of the temperature sensors is located within a middle 50% of the bundle height.

7. The coil-wound heat exchanger of claim 5, wherein the warm bundle has a bundle height extending from the cold bundle end to the warm bundle end and each of the temperature sensors is located within a middle 20% of the bundle height.

8. The coil-wound heat exchanger of claim 1, further comprising a first inlet conduit in fluid flow communication with the first group of tube sheets and the second group of tube sheets and a second inlet conduit in fluid flow communication with a third group of tube sheets and a fourth group of tube sheets.

9. The coil-wound heat exchanger of claim 8, wherein the third group of tube sheets is located at the first bundle end, each of the third group of tube sheets being in fluid flow communication with more than one of the plurality of tube sets at the first tube end and the second group of tube sheets is located at the second bundle end, each of the second group of tube sheets being in fluid flow communication with more than one of the plurality of tube sets at the second tube end.

10. The coil-wound heat exchanger of claim 1, wherein the plurality of zones comprise an innermost zone and an outermost zone, wherein at least one of the innermost zone and the outermost zone each contains between 10 and 20 percent of the plurality of tubes.

11. The coil-wound heat exchanger of claim 1, wherein the plurality of zones comprise an innermost zone and an outermost zone, wherein at least one of the innermost zone and the outermost zone each contains less than 10 percent of the plurality of tubes.

* * * * *